US009578924B2

(12) United States Patent
Rupprecht

(10) Patent No.: US 9,578,924 B2
(45) Date of Patent: Feb. 28, 2017

(54) HIGH-HEELED SHOE

(76) Inventor: Gabriela Rupprecht, Wiesbaden (DE)

( * ) Notice: Subject to any disclaimer, the term of this patent is extended or adjusted under 35 U.S.C. 154(b) by 229 days.

(21) Appl. No.: 14/112,875

(22) PCT Filed: Apr. 18, 2012

(86) PCT No.: PCT/EP2012/057096

§ 371 (c)(1),
(2), (4) Date: Dec. 20, 2013

(87) PCT Pub. No.: WO2012/143406

PCT Pub. Date: Oct. 26, 2012

(65) Prior Publication Data

US 2014/0196319 A1 Jul. 17, 2014

(30) Foreign Application Priority Data

Apr. 18, 2011 (DE) ..... 10 2011 007 623
Jul. 13, 2011 (EP) ..... 11173737

(51) Int. Cl.
*A43B 13/28* (2006.01)
*A43B 13/34* (2006.01)
(Continued)

(52) U.S. Cl.
CPC ..... *A43B 21/26* (2013.01); *A43B 7/144* (2013.01); *A43B 7/145* (2013.01); *A43B 7/1445* (2013.01);
(Continued)

(58) Field of Classification Search
CPC ..... A43B 7/144; A43B 13/182; A43B 13/184; A43B 13/189; A43B 21/00; A43B 21/08; A43B 21/24; A43B 21/26; A43B 21/265; A43B 21/28; A43B 21/285; A43B 21/30; A43B 21/42; A43B 21/437; A43B 21/47
(Continued)

(56) References Cited

U.S. PATENT DOCUMENTS 255,871 A * 4/1882 Kerr ..... 36/38
1,439,104 A * 12/1922 Helwitz ..... A43C 13/00 36/72 B
(Continued)

FOREIGN PATENT DOCUMENTS

CN 2225781 Y 5/1996
CN 1897839 A 1/2007
(Continued)

OTHER PUBLICATIONS

Dufour et al., "Foot Pain: Is Current or Past Shoewear a Factor?", Arthritis & Rheumatism (Arthritis Care & Research), 61(10): 1352-1358, Oct. 15, 2009.
(Continued)

*Primary Examiner* — Anna Kinsaul
*Assistant Examiner* — Jameson Collier
(74) *Attorney, Agent, or Firm* — Seager, Tufte & Wickheim, LLP

(57) ABSTRACT

A high-heeled shoe having a sole and a heel of at least 4 cm height provided thereto, wherein the heel is provided with a damping element. The damping element has different effective damping cross sections along the heel's longitudinal axis and/or is freely deformable in at least one direction perpendicular to the heel's longitudinal axis.

25 Claims, 11 Drawing Sheets

(51) Int. Cl.

| | |
|---|---|
| ***A43B 21/00*** | (2006.01) |
| ***A43B 21/24*** | (2006.01) |
| ***A43B 21/26*** | (2006.01) |
| ***A43B 21/30*** | (2006.01) |
| ***A43B 7/14*** | (2006.01) |
| ***A43B 13/18*** | (2006.01) |

(52) U.S. Cl.
CPC ..... *A43B 13/189* (2013.01); *A43B 21/00* (2013.01); *A43B 21/265* (2013.01); *A43B 21/30* (2013.01)

(58) Field of Classification Search
USPC ..... 36/102, 105, 27, 28, 34 R, 35 R, 38
See application file for complete search history.

(56) References Cited

U.S. PATENT DOCUMENTS

| | | | | | |
|---|---|---|---|---|---|
| 1,875,806 | A * | 9/1932 | Givens | A43B 3/166 | 36/72 B |
| 2,159,943 | A * | 5/1939 | Palley | 36/38 | |
| 2,807,100 | A | 9/1957 | Windle | | |
| 2,825,154 | A * | 3/1958 | Windle | 36/38 | |
| 2,836,906 | A * | 6/1958 | Josephi | 36/34 R | |
| 2,836,907 | A * | 6/1958 | Windle | 36/38 | |
| 3,043,024 | A * | 7/1962 | Haug, Jr. | 36/36 R | |
| 3,144,722 | A * | 8/1964 | Cortina | 36/36 R | |
| 3,174,235 | A * | 3/1965 | Johnston | 36/36 R | |
| 3,218,735 | A * | 11/1965 | Ball | 36/34 A | |
| 3,222,801 | A | 12/1965 | Mostertz | | |
| 3,266,177 | A * | 8/1966 | Holden | 36/36 C | |
| 4,133,086 | A * | 1/1979 | Brennan | 36/7.8 | |
| 4,848,008 | A * | 7/1989 | Kuehnle et al. | 36/35 R | |
| 4,953,310 | A * | 9/1990 | Haug | 36/38 | |
| 5,063,691 | A * | 11/1991 | Haug | 36/35 R | |
| 5,325,612 | A * | 7/1994 | Lock et al. | 36/34 R | |
| 5,697,171 | A * | 12/1997 | Phillips | 36/3 B | |
| 5,829,168 | A * | 11/1998 | Fusaro | A43B 21/26 | 36/34 B |
| 6,442,872 | B1 * | 9/2002 | Liao | 36/67 D | |
| 7,140,125 | B2 | 11/2006 | Singleton et al. | | |
| 2002/0083616 | A1 * | 7/2002 | Hajianpour | 36/7.8 | |
| 2002/0133980 | A1 | 9/2002 | Pan | | |
| 2005/0081401 | A1 * | 4/2005 | Singleton et al. | 36/34 R | |
| 2008/0196279 | A1 * | 8/2008 | Epping | A43B 3/0078 | 36/72 B |
| 2011/0061270 | A1 * | 3/2011 | Vieira Teixeira Alves Gomes et al. | 36/34 R | |
| 2011/0225842 | A1 * | 9/2011 | Lu | 36/27 | |
| 2014/0082972 | A1 * | 3/2014 | Jones | A43B 3/001 | 36/34 R |

FOREIGN PATENT DOCUMENTS

| | | | |
|---|---|---|---|
| DE | 1485705 | A1 * | 2/1970 |
| DE | 2908023 | A1 | 9/1980 |
| DE | 2933393 | A1 * | 2/1981 |
| DE | 4219125 | A1 | 12/1993 |
| DE | 4219152 | C2 | 8/1994 |
| DE | 4219125 | C2 | 1/1996 |
| DE | 4219152 | C3 | 8/1996 |
| DE | 29807242 | U1 | 8/1998 |
| EP | 295611 | A2 * | 12/1988 |
| ES | 2278474 | B1 | 6/2008 |
| FR | 1131822 | A * | 2/1957 |
| FR | 1227004 | A * | 7/2002 |
| GB | 974254 | A | 11/1964 |
| WO | 2005039339 | A2 | 5/2005 |
| WO | 2006126798 | A1 | 11/2006 |
| WO | 2010028469 | A1 | 3/2010 |

OTHER PUBLICATIONS

Gustafsson et al., "Dämpfungsmessung von Laufschuhen", Medizin & Technik, 36-41, May 2010. See attached English Summary).
Hansen et al., "Effects of Shoe Heel Height on Biologic Rollover Characteristics During Walking", Journal of Rehabilitation Research and Development, 41(4): 547-554, Jul./Aug. 2004.
Debrunner, Hans U. et al., "Biomechanik des Fuessess", Ferdinand Enke Verlag Stuttgart, p. 19, 1998. See attached English Summary).
Debrunner, Alfred M., "Orthopadie, Orthopadische Chirurgie: Patientenorientierte Diagnostik and Therapie des Bewegungsapparates", p. 1123, 2002. (See attached English Summary).

* cited by examiner

HIGH-HEELED SHOE

CROSS-REFERENCE TO RELATED APPLICATIONS

This application is a National Stage of International Application No. PCT/EP2012/057096, filed Apr. 18, 2012, which claims the benefit of European Patent Application No. 11173737.5, filed Jul. 13, 2011 and German Patent Application No. 10 2011 007 623.9, filed Apr. 18, 2011, the entire disclosures of which are incorporated herein by reference.

TECHNICAL FIELD

The present invention relates to a high-heeled shoe having a shock-damping, soundless heel which can also have an extremely high and particularly slender configuration.

BACKGROUND

These heels require a specific type of damping due to the enhanced load and pressure conditions. A research study among almost 2,000 women published in the technical journal Arthritis Rheum. (15 Oct. 2009; 61(10):1352-1358) shows that in most cases heel or ankle pains are the result of wearing high-heeled shoes in the past. This is one of the 20 most frequent reasons for consulting a doctor for women at the age of 65 to 74 years.

SUMMARY

The present invention allows for pain-free wearing of high-heeled shoes over a long period of time, while, compared to conventional high-heeled shoes, the present invention simultaneously spares the joints which are particularly affected by the extreme tilt. This is rendered possible by a biodynamic construction in the heel, which follows and simulates the function of physiological shock damping and thus provides stability at concurrent, minimum relative movement for damping the shocks.

The sole of the foot has an anatomical structure which is adapted to the local pressure load like a shock damper. Under load the sole deforms in a non-linear manner. Under increasing load the sole initially offers little resistance to the compressing force; under heavy load the sole becomes increasingly harder (Biomechanik des Fuβes, Debrunner, Hilaire, 1998, p. 19). When the foot arch and the muscle and joint structures of the foot are unimpaired, the entire body load is distributed upon these loadable sole surfaces, a different load distribution almost always leads to medical problems (Orthopädie, Orthopädische Chirurgie: Patientenorientierte Diagnostik and Therapie des Bewegungsapparates, Debrunner, 2002, p. 1123).

DETAILED DESCRIPTION

The physiological damping properties of the foot's heel when striking the ground are based on the principle of displacement. Under load the heel bone lowers towards the ground and shifts the underlying soft tissue structure towards the periphery. Hence, under load on even ground, a hemispherical pressure distribution occurs under the foot's heel, with maximum pressure under the heel bone. A reference value for normal physiological load under the foot's heel is indicated at a pressure of about 30 Newton/cm$^2$. When wearing very slender heels with a diameter of, in some cases, less than 10 mm, weight is distributed upon a substantially smaller surface and the pressure load can be many times higher than normal pressure load.

When walking normally in flat shoes these forces are transmitted from the loaded bones to the ground via the soft tissue structure. The interaction of stability and dynamics is also essential for optimal functioning: While strong structures—especially bones—and strained muscles provide for sufficient stability, the joints—especially the cartilages—have to display high elasticity of compression.

The process of absorbing body load starts with the initial ground contact. When walking in flat shoes the ankle joint is in a neutral position (internal angle: 90°) when initially striking the ground. For a long enough period the foot's heel thus serves as support and an optimum rolling movement over the foot's heel is created in order to achieve continuity of movement.

In high-heeled shoes the starting position of the ankle joint is different: Due to the tilt of the entire foot, the angle is not 90°, but can, dependent on the height of the heel, range between over 100° and as much as 160° in extreme cases. At an average height of 10 cm the foot is tilted at an angle of about 135-140°. This has a considerable impact on the weight distribution and the load forces which act on the joints. Already during normal walking in flat shoes, a vertical force can be generated when the heel strikes the ground, which exceeds the vertical force of the body's own weight. The higher the heel, the greater the angle and the greater the pressure on the foot's heel when initially striking the ground.

This pathological pattern of movement is further enhanced by elegant and high-heeled shoes having a heel diameter of only a few millimeters at the lower end. When the foot, i.e. the foot's heel strikes the ground the whole weight is centered in this area.

The greater the surface due to a greater heel diameter, the better the weight distribution. The smaller the heel diameter at the lower end, i.e. the smaller the heel tip, the more weight impacts on a very small surface (pressure=force/surface [Newton/cm$^2$]). In the long run this increased pressure can no longer be balanced by normal, physiological damping. The joints are overstrained due to the unphysiological position of the foot and the increased pressure. Such changes are already to be expected with a heel separation starting from 5 to 6 cm (Hansen, Childress, Journal of Rehab R&D, Volume 41(4), pages 547-554).

Some flat shoes, in particular sports shoes, already offer various damping systems. Their purpose is to reduce the load on the joints, in particular ankle and knee joints, when the foot's heel strikes the ground and to alleviate the rolling over the midfoot and the balls. With flat shoes these damping systems are mostly integrated into the sole of the shoe and are commonly arranged at least in the region of the foot's heel.

While in the beginning of this development very soft materials were used for supporting the sinking into the heel bed, it meanwhile turned out that a compression (i.e. the distance by which the thickness of an elastic sole is reduced when the foot's heel strikes the ground) that is too large can also lead to instability of the joints. Based on the latest findings, the perfect shoe features a small travel and sufficiently high damping (Orthopädie Schuhtechnik, Dämpfungsmessung von Laufschuhen, Gustafsson, Heitz 5/2010, page 38).

The idea of shock-damping for outdoor shoes has also been recognized and to some extent realized in the form of patents. Most often, the embodiments described therein do not meet the practical requirements of sufficient stability of the overall construction while providing adequate elasticity at the same time. Moreover, most of them refer to thick and very thick heels that can even reach the shape of a wedge. This hardly accounts for the above-described increased load conditions with slender and/or high heels. Heels for high-heeled shoes, therefore, continue to be manufactured from hard plastics, metals or metal alloys, which provide no damping or insufficient damping when the heel of the foot strikes the ground. Although women's shoes with damped heels are generally known from the prior art, so far, no satisfying solution has been provided which is commercially realizable and capable of prevailing on the market. Known constructions turned out to be poor in practice, because they—as detected by the inventor of the present invention—allow instabilities or frictional noises. The practical realization often requires considerable mounting space opposing an elegant and slender heel design.

There are, for instance, women's shoes with pneumatic chambers inside the heel for damping the steps. Yet, this construction requires a comparably greater mounting space which seems to oppose a heel having a very slender design when viewed from all angles. In addition, sealing and durability problems emerge.

Document DE 42 19 152 A1 describes a heel with a resilient outer shell pulled over a hard and solid inner core. Said construction neither allows a slender heel design nor sufficient damping.

Document DE 2 908 023 A1 discloses a heel having an interlayer made of resilient material. When taking into account that no less than the body's own weight impacts on the heel when the foot strikes the ground (depending on pace and speed—e.g., when running—the force can be 1.5 to 2.5 times more than that), it has to be assumed that a relatively thick layer of resilient material is required, which opposes the stability and practicability of such shoes.

Document U.S. Pat. No. 7,140,125 B2 describes high-heeled footwear with resilient compressible elements in the heel. The elements described therein are said to spring strongly. Yet, with the constructions described above, neither a normal pace nor sufficient damping is to be expected.

Document DE 298 07 242 U1 discloses a cushion for women's shoes with a heal separation of 30 mm, which fills the cavity between foot and shoe in the lateral region and has an arcuate notch in front of the foot's heel. In this way the foot's heel is to be enclosed and the foot is to be prevented from slipping towards the toe of the shoe.

The underlying object of the present invention is to provide high-heeled shoes with an improved damping means with the particular aim to remove the disadvantages of known devices. This task is solved by the features of the claims. Preferred embodiments can be found in the dependent claims.

The basic idea underlying the present invention is to provide a heel of a high-heeled shoe with a damping means comprising at least one damping element which has different effective damping cross sections along the heel's longitudinal axis and/or is freely deformable in at least one direction perpendicular to the heel's longitudinal axis. The heel has a top portion and a bottom portion separated by a vertical midpoint along the longitudinal axis, wherein the at least one damping element is arranged entirely within the top portion of the heel. The damping means is preferably configured such that the damping is at least partially achieved through the expansion of different effective damping cross sections in a direction perpendicular to the heel's longitudinal axis. More preferably, the damping means is configured such that the damping is at least partially achieved by the free expansion of all effective damping cross sections in a direction perpendicular to the heel's longitudinal axis. This ensures that the elastic properties come into effect and are not affected by a counterproductive stiffness of the material. Preferably, the damping element can be deformed by at least 3 mm or at least 5 mm in a direction perpendicular to the heel's longitudinal axis.

The damping means according to the present invention is designed for high-heeled shoes with a heel height of at least 4 cm, preferably at least 6 cm, more preferably at least 8 cm, and most preferably at least 10 cm. In the context of this invention the heel height is defined as the medium height of the heel, which indicates the difference in height between the region of the ball and the foot's heel in the region of the heel center, when looking at the shoe from the side.

The damping means according to the present invention is preferably provided for high-heeled shoes having a heel diameter of maximum 4 cm, preferably of maximum 2 cm, and more preferably of maximum 1.2 cm or of maximum 1.0 cm, with a heel height of at least 4 cm, preferably at least 5 cm, more preferably at least 6 cm, and most preferably of at least 8 cm. It is particularly preferred that substantially over its entire length or height the heel diameter is no larger than 4 cm, preferably no larger than 2 cm and more preferably no larger than 1.2 cm or no larger than 1.0 cm. Preferably, the heel diameter of the high-heeled shoes is no larger than 4 cm, preferably no larger than 2 cm, and more preferably no larger than 1.5 cm also in the region of the damping element.

Furthermore, the damping means according to the present invention is preferably provided for high-heeled shoes with a ratio of heel height to heel diameter of at least 2.5, more preferably of at least 4.0, even more preferably of at least 5.0, and most preferably of at least of 7.5. The ratio of heel height to heel diameter preferably ranges between 2.5 and 15.0, more preferably between 4.0 and 12.0.

The high-heeled shoes according to the present invention preferably comprise an upper heel part and a lower heel part, wherein the lower heel part is movable or slidable in at least one direction, preferably in the heel's longitudinal direction (axial direction of the heel), with respect to the upper heel part. The damping element of the damping means is preferably arranged between the upper heel part and the lower heel part such that the forces between the heel parts in at least one direction are transmitted only via the damping element. Preferably, the damping element restricts the relative movement of both heel parts in at least one direction and damps the transferred shocks. In this way, for example, the damping element can be arranged between the upper heel part and the lower heel part such that the forces which act in the heel's longitudinal direction and which act on the foot's heel when the heel tip strikes the ground, are damped.

The damping element of the damping means preferably comprises a gel-like or elastic material. The damping element preferably comprises polymers (e.g. thermoplastics, elastomers, thermoplastic synthetic materials), polyurethane, natural rubber, rubbers or rubber-like plastics, foams and/or cork or cork-like material (e.g., cork latex compounds). Materials with high rebound capacities are particularly suitable.

Along the heel's longitudinal axis and perpendicular to said axis the damping element preferably comprises different cross sections varying in surface area and/or shape in order to allow for the damping properties' individual adjustment to the wearer's requirements. Thus, the cross-sectional portions of varying surface area and/or shape provide different damping properties and/or degrees of stiffness and deform differently when the force is transmitted from one heel part to the other via the damping element. At that, the lateral extension perpendicular to the heel's longitudinal axis is preferably not or not substantially impeded in at least one direction.

Although the damping element can well consist of discrete portions each having constant cross-sectional surface areas, it is preferred that the cross-sectional change and/or the change of cross-sectional surface along the heel's longitudinal axis, follows, at least partially, a continuous function. Said function can be defined depending on the desired properties of the damping element.

Preferably, the ratio of the largest cross-sectional surface of the damping element to the smallest one amounts to at least 1.3, preferably to at least 1.5, more preferably to at least 4.0. The damping element can have a convex or concave configuration in at least one section. In addition, the damping element can at least partially have a spherical or substantially spherical configuration. Along the heel's longitudinal axis the damping means or damping element has a height of preferably at least 1.0 cm, more preferably of at least 2.0 cm or even of at least 3 cm or 4 cm, in order to sufficiently damp the shock when the foot's heel strikes the ground. The volume of the damping element and/or all damping elements preferably ranges between 0.5 and 15.0 $cm^3$, preferably between 1.75 and 5.0 $cm^3$, more preferably between 1.5 and 4.0 $cm^3$.

The damping elements of the high-heeled shoes according to the present invention can have a multitude of shapes, as long as the desired advantageous shock damping is achieved in combination with the material of the damping element, the heel shape, the heel material or further potential components of the shoe (e.g., heel tip, shoe support, midsole, insole). When looking at the shoe from the side, the damping element can have the shape of e.g., a sphere, hemisphere, ellipse, egg, pear, heart, cross, flower, pyramid or cone, or for instance the shape of a cube standing on the edge, or a combination thereof. A variety of further shapes is possible.

The damping element is preferably configured such that all cross-sectional surfaces at least partially overlap each other in a direction perpendicular to the heel's longitudinal axis so as to distribute the pressure while the flow of force from one heel part to the other is not redirected in the damping element. The shape of the elastic part should preferably follow the physiological damping properties of the foot and increasingly damps under increasing weight load or pressure (progressive characteristic). Hence, the force counteracting the deformation rises disproportionately under increasing compression. The damping element is preferably not a coil spring or leaf spring.

The damping means of the high-heeled shoe according to the present invention preferably comprises at least one transmitting and/or guiding element that extends throughout the damping element. The transmitting and/or guiding element can be configured such that forces and/or shocks which do not act in the direction of the heel's longitudinal axis can be directly transmitted from one heel part to the other without loading the damping element. Moreover, the transmitting and/or guiding element is preferably configured such that it guides the damping element and prevents its lateral breakaway. Alternatively or additionally, the damping element can be firmly attached to the lower and/or upper heal part by bonding, for example.

According to a preferred embodiment of the invention, the transmitting and/or guiding element is firmly attached to the lower heel part and/or the heel tip. Preferably, the transmitting and/or guiding element extends from the upper heel part to the heel tip and comprises an internal thread at the lower end, in which the heel tip can be screwed in. Furthermore, the transmitting and/or guiding element is preferably provided with an external thread through which the lower heel part can be screwed onto the transmitting and/or guiding element. Likewise, alternative fixing methods and/or means can be used (e.g., bonding, pressing, nailing, welding and/or engaging mechanisms). Preferably, the transmitting or guiding element is firmly attached to the lower heel part and embedded in the upper heel part in a stable manner, extending, for instance, over at least 50%, at least 60%, at least 75%, at least 90% or the entire heel length. An adequate length ensures the long-term stability of the heel and forestalls its fracture.

Despite the importance of reaching this stability, there has to be enough room for sufficient relative movement at the same time. According to a preferred embodiment of the invention, the transmitting and/or guiding element is movably mounted in the upper heel part and is preferably axially slidable along the heel's longitudinal axis. When load is taken off the heel, said element is preferably in an extended position, and, when the heel is loaded, it shifts towards the upper heel part. This relative movement and freedom of motion allows for a particularly advantageous positioning of the elastic plastic part which is capable of providing the shock-damping effect.

The axially slidable mounting of the transmitting and/or guiding element in the upper heel part is preferably implemented by means of a piston-cylinder connection. At that, the upper heel part or a sleeve provided therein (cylinder sleeve) preferably forms a cylinder which surrounds the transmitting and/or guiding element. It is clear to the skilled person that said surrounding cylinder can be provided, for instance, through a cylindrical opening in the upper heel part. In case a cylindrical sleeve is used, a thread can be provided outside the sleeve so that it can be screwed in a thread in the upper heel part and be mounted therein in a stable manner. Cylinder and piston can each have a circular or a non-circular cross section (e.g., oval, rectangular, square etc.).

In this case the upper end of the transmitting and/or guiding element preferably forms a piston which is mounted in the surrounding cylinder such that it can be moved along the heel's longitudinal axis. This construction enables a particularly slender heel design with reliable and stable mounting of the transmitting and/or guiding element in the upper heel part. Alternatively, the upper heel part can form the piston and the transmitting and/or guiding element can form the cylinder, for example for shoes according to the present invention with thicker heels.

Preferably, the transmitting and/or guiding element is prevented from dropping out of the surrounding cylinder by a securing mechanism. For this purpose a pin can be used, which is connected with the upper heel part and protrudes into or extends through an opening of the transmitting and/or guiding element. Alternatively, the cylinder can be provided with a lower end stop which restricts the axial movement of the transmitting and/or guiding element. This can, for instance, include a lower end piece which comprises an opening for the transmitting and/or guiding element, but which at least partially covers a lower axial opening of the cylinder. The end piece can be fixed to the cylinder by welding, soldering, gluing or other fixing methods and/or means or it could be configured integrally with the cylinder. If the cylinder is provided with a lower end piece, the transmitting and/or guiding element will preferably comprise an enlarged cross section or head in its upper end region so that the end piece prevents the upper end region from slipping out of the cylinder. The cylinder can be sealed (e.g., after insertion of the transmitting and/or guiding element) by means of an upper lid when the lower end piece is configured integrally with the cylinder. Preferably, the material is selected such that it is impossible for the enlarged cross section to break loose, which could lead to instability.

Experiments show that the use of the above-disclosed piston-cylinder connection can generate considerable noise during loading and unloading of the heel. This would considerably impair or even thwart industrial applicability. Therefore, the piston-cylinder connection according to the present invention is preferably provided with at least one, more preferably several, means for noise reduction which reduce or prevent the generation of noise when the heel strikes the ground and when it is lifted off the ground, in particular the noise generated by the movement of the piston inside the cylinder.

The piston-cylinder connection preferably comprises at least one buffer and/or damping element, which prevents the piston from bumping or bouncing against an axial end of the cylinder.

The piston-cylinder connection preferably comprises an upper buffer arranged between the transmitting and/or guiding element and the upper end of the cylinder. Said buffer reduces the noise generated when the heel is under load and, depending on its construction, partially contributes to the shock damping of the damping means according to the present invention. Preferably, the buffer is at least to a certain extent freely deformable in a direction transverse to the heel's longitudinal axis and can be configured as, for example, solid cylinder, hollow cylinder, sphere, hollow sphere or hemisphere (angular shapes are theoretically also possible). The upper buffer can be loosely inserted in a clearance between the transmitting and/or guiding element and the end of the cylinder. Alternatively, the upper buffer could be attached to the transmitting and/or guiding means, e.g., at or on its upper end, and/or to the cylinder, e.g., at its upper end. Attachment can be effected, for example, by gluing, welding and/or injection molding.

Furthermore, the piston-cylinder connection is preferably provided with at least one lower buffer which prevents the piston from bumping against the lower end of the cylinder and thus reduces the generation of noise when the heel is lifted. Depending on the configuration of the piston-cylinder connection, said buffer can be arranged between the transmitting and/or guiding element and a lower end of the cylinder (e.g., a lower end piece) and can have the shape of a ring and/or a hollow cylinder. If the piston comprises a head at its upper end, the lower buffer can, for example, be attached below said head or above a lower, axial end of the cylinder. If a pin is used in order to prevent the transmitting and/or guiding element from slipping out of the cylinder, the lower buffer can also be provided between the transmitting and/or guiding element and said pin. The lower buffer is preferably made of polymers (e.g., thermoplastics, elastomers, thermoplastic synthetic materials), polyurethanes, natural rubber, rubbers or rubber-like plastics, foams and/or cork or cork compounds (e.g. cork latex compounds).

The movement of the piston in the guiding channel generates sliding friction. Said sliding friction depends on the pressure, speed, type of material and roughness of the friction surfaces. In order to reduce or prevent said sliding friction, the piston-cylinder connection can further comprise an anti-friction coating (e.g., industrial ceramics, polymers, PTFE, nanostructures, nickel, chromium, zinc, varnishes, powders and/or diamond like carbon—DLC) which can optionally be provided on the inner circumferential surface of the surrounding cylinder and/or on the outer circumferential surface of the transmitting and/or guiding element.

The DLC coating is a coating of amorphous carbon (ta-C or in combination with hydrogen a-C:H).

DLC layers are produced in a reactor which is under vacuum. Two horizontally fitted graphite electrodes between which an electric arc is ignited are located in the reactor. One graphite electrode serves as cathode, the other one serves as anode. Argon which ionizes very easily is supplied in addition for igniting the electric arc. The graphite on the electrodes is transferred into the plasma phase due to the extremely high temperatures in an electric arc. The plasma which is generated through the energy input of the electric arc is located between the cathode and the anode in the form of a cloud. A substrate holder is placed underneath the plasma cloud, on which a sample of metal, plastics or glass is laid.

Due to the spatial proximity of the plasma, the carbon in the plasma phase is deposited on the substrate in the form of thin DLC layers. In addition, a pulsed bias voltage is applied whereby the carbon within the plasma reaches the substrate with correspondingly high energy. The high energy causes the formation of $sp^3$ bonds. Until a maximum is reached, it holds that the higher the bias voltage, the harder the layer.

If a pin is used, which is connected to the upper heel part and protrudes into and/or runs through an opening of the transmitting and/or guiding element, said pin and/or the opening can be fully or partially coated with a low-friction surface.

By coating the cylinder and/or the piston of the piston-cylinder system with a low-friction surface, the frictional resistance and hence the noise generation occurring when the piston moves in the cylinder can be greatly reduced.

Alternatively or additionally, inserts and/or coatings made of the above-mentioned materials can be provided. Thus, in order to reduce friction a sleeve, or a slide bearing (e.g., made of polytetrafluoroethylene or industrial ceramics) can be inserted into the surrounding cylinder.

Eventually, also the upper heel part can be made of a low-friction material. In the context of the present invention, low-friction material refers to a material having a lower coefficient of (sliding) friction than the cylinder and/or piston material. In the embodiment including a pin, said pin can comprise a surface of low-friction material or can be made of such material. The respective areas of the opening of the transmitting and/or guiding element can also be provided with such a low-friction surface. It is clear to the skilled person that the above-described means for noise reduction can be applied individually or, preferably, in combination.

According to a preferred embodiment of the invention, the piston-cylinder connection comprises an anti-rotation protection which prevents the transmitting and/or guiding element from rotating with respect to the upper heel part. Said anti-rotation protection can, for instance, be realized through the above-described pin which is connected to the upper heel part. Furthermore, the cylinder and/or the piston can be provided with an inner and an outer profile, respectively, as a protection against rotation. In a view cross-sectional to the heel's longitudinal axis said profile is not circular (e.g., polygonal, angular, rectangular, hexagonal, oval or with a straight side).

The damping element is preferably visible from outside, which allows for a slender heel design while at the same time ensuring the damping element's free deformability in a direction perpendicular to the heel's longitudinal axis. Nevertheless, mounting inside the heel is also possible. In this case, however, the damping element should be freely deformable in preferably at least one direction perpendicular to the heel's longitudinal axis and/or its lateral expansion should not be restrained in order to allow the resilient property required for the damping to unfold. Preferably, the heel of the high-heeled shoe according to the present invention has a diameter of at least 1 cm, and preferably at least 1.2 cm in the region of the damping element.

Besides, the damping means can comprise additional springs in order to ensure the resetting of the damping element or in order to movably connect the upper heel part with the lower heel part.

The heel and the damping means are preferably configured such that the damping element can be easily replaced.

The high-heeled shoe according to the present invention preferably combines the described damping means with additional measures adapted for further taking load off the foot and/or the foot's ball. For example, the longitudinal arch can be elevated in order to accommodate the cavity for obtaining greater stability. In addition, the ball region can be padded with cork, latex, gel or an equally soft material. It is particularly preferred to lower the cushion in the foot's heel region and to pad said region with gel or an equally soft material in order to shift the wearer's weight on the foot's heel more than other high-heeled shoes with a comparable heel separation. By way of example, this can be achieved by a specific shaping of the sole.

Hence, the present invention describes demonstrably functioning, shock-damping heels which follow the principle of physiological damping and, thus, ensure stability at simultaneous relative movement. Due to the heels' space-saving construction, they can also be used for extremely slender and/or high models and, thus, combine wearing comfort and pre-emptive, joint-friendly measures with stylish and aesthetic design.

Compared to the prior art described in the beginning, the heels and/or high-heeled shoes according to the present invention realize at least some, and preferably several of the following advantages:

Adapting the Structural Design to the Shaping

A physiological damping structure designed according to different criteria will be all the less effective in the foot and/or joint region, the higher the position of the foot's heel (the higher the heel) and the larger the angle in the ankle joint when the heel of the foot strikes the ground. An additional external shock damping is therefore all the more important. The same applies to particularly slender heels, in which case the pressure on the foot's heel is many times higher due to the small heel diameter. A combination of both criteria (slender and high heel) enhances this negative effect which worsens with increasing height and decreasing heel diameter. Yet, for exactly these kinds of shoes, adequate counter measures are not available. This problem can be solved by the present invention, which provides the required shock damping in a particularly space-saving way.

Stability

The transmitting and/or guiding element, which is preferably made of robust materials such as metals, metal alloys or plastics and which can extend along a major part of the heel, enables a stable construction. The upper heel part and the lower heel part are, in an advantageous manner, connected with each other in a stable manner through the combination of guiding element and cylinder (i.e. through the piston-cylinder connection). Since the guiding element can move only a few millimeters in an axial direction inside the upper cavity of the cylinder and the guiding element is prevented from fully sliding out of the cavity, the relative movement of the heel parts is additionally restricted in an advantageous manner. The means for noise reduction according to a preferred embodiment of the invention further ensure low-friction movement which effectively prevents the generation of audible sounds. In order to further enhance stability an anti-rotation protection can be provided, which restricts the guiding element's movement in a particularly space-saving way, so that the guiding element can only move in one direction (along the longitudinal axis) and a rotation of the lower heel part with respect to the upper heel part is not prevented or strongly limited.

Elasticity

The elastic part (damping element) between the upper heel part and the lower heel part of the high-heeled shoe according to the present invention can, despite its compact design, absorb high pressures which occur with the described heel diameters and the overstretched position of the ankle, wherein the acting force can amount to 2.5 times the body weight of the wearer. In order to ideally support the physiological damping, the damping element can be selected such that with an increasing compression a greater increase in force is required for the same travel (progressive spring characteristic). In the region of maximum compression the force required for compression of the damping element preferably increases disproportionately. Thus, the damping element preferably reacts very sensitive towards load in the beginning, but becomes stiffer the more it is deformed and, thus, corresponds to the physiological shock damping structure of the foot's heel region.

The construction according to the present invention can thus ensure that the damping element is freely deformable in at least one direction. Contrary to some of the documents cited in the beginning, the high-heeled shoe according to the present invention ensures that the damping element is sufficiently deformable under pressure. This is advantageous, because some of the particularly suitable materials (e.g., elastic polymers such as elastomers, polyurethanes, rubber, etc.) are predominantly incompressible and, consequently, their volumes hardly change under pressure. Hence, the materials could become stiff—which is counterproductive especially for shock damping—unless sufficient space for deformation is provided.

Further Measures For Increasing Wearing Comfort

It can be furthermore assumed that, in particular, the combination and the mutual adjustment of the damping system, cushion and shoe design are essential for the standing and walking properties of the high-heeled shoes and hence for wearing comfort.

BRIEF DESCRIPTION OF THE DRAWINGS

Preferred embodiments of the high-heeled shoe according to the present invention are described in the following with reference to the Figures. The Figures show:

FIG. 7*a*-7*m* exemplary shapes of damping elements for use in high-heeled shoes according to the present invention;

FIG. 1 schematically illustrates a high-heeled shoe according to a first embodiment of the invention. The high-heeled shoe 1 essentially comprises an outsole 6, an insole 7, a soft inner sole 8 and a sock 9 as well as a heel in the region 10 of the foot's heel. Between the insole 7, the inner sole 8 and the sock 9 and/or as a component of one of the soles, pads 31 can be arranged in the foot's heel region 10, pads 32 in the midfoot region and/or pads 33 in the ball region. These pads can be made of gel or an equally soft material. The foot's heel region 10 can be flattened or lowered through a specific sole shaping. The heel can comprise a heel tip at its lower end.

FIGS. 1 and 2*a* show, in particular, that the heel of the illustrated high-heeled shoe 1 is preferably provided with a lower heel part 2 and an upper heel part 3 as well as a damping means 20 comprising a damping element 21. The damping element is arranged between the lower heel part 2 and the upper heel part 3 and is visible from outside. The damping element 21 preferably comprises different effective damping cross sections $A_1, A_2, \ldots, A_i$ along the heel's longitudinal axis and is freely deformable in a direction perpendicular to the heel's longitudinal axis towards the outside, preferably essentially along its entire height in the heel's axial direction.

Figure 1:
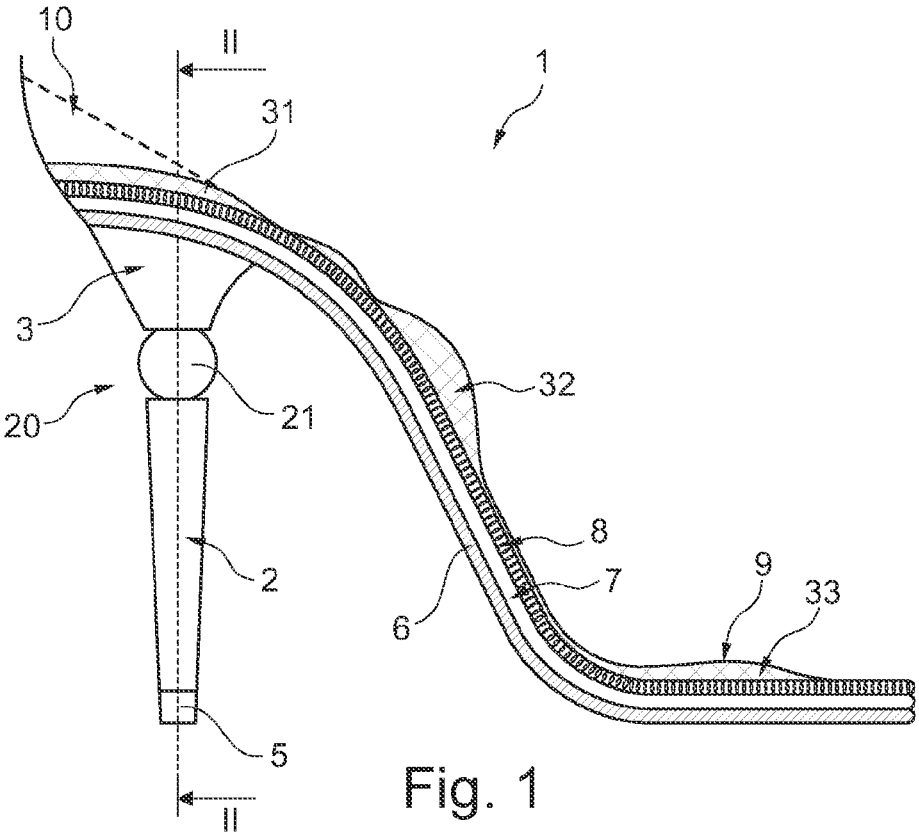
FIG. 1 a schematic side view of a high-heeled shoe comprising a damping means in the heel according to an embodiment of the invention.
Figure 2A:
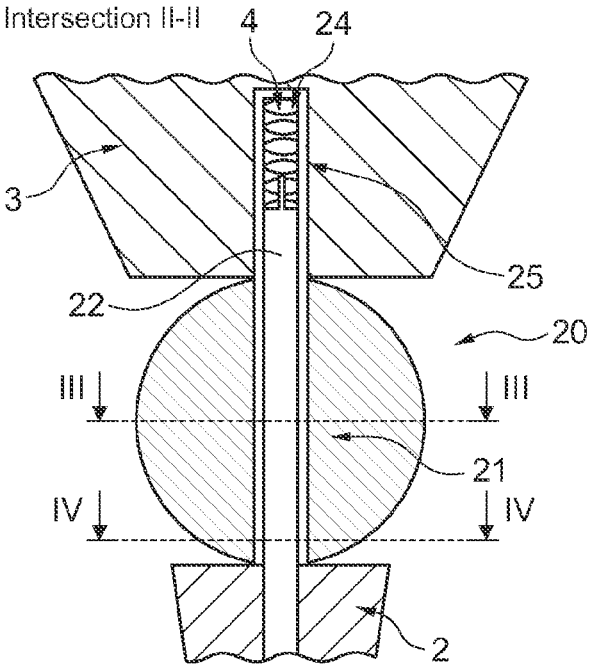
FIG. 2*a* a detail of a cross-sectional view along the line II-II of FIG. 1, showing a mounting option for a damping means in a high-heeled shoe according to the present invention.
Figure 2B:
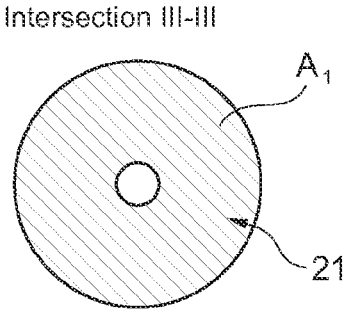
FIG. 2*b* a cross-sectional view of the damping element of a high-heeled shoe according to the present invention along the line III-III of FIG. 2*a;*
Figure 2C:
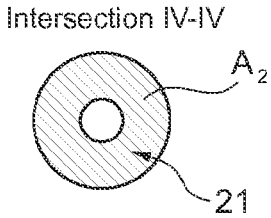
FIG. 2*c* a cross-sectional view of the damping element of a high-heeled shoe according to the present invention along the line IV-IV of FIG. 2*a;*

As can be taken from FIGS. 2*b* and 2*c*, the different effective damping cross-sections $A_1, A_2, \ldots, A_i$ can have different surface areas. Alternatively to the above or in combination therewith, the different damping cross-sections $A_1, A_2, \ldots, A_i$ can also differ in shape. Should the damping element 21 have a spherical shape as shown in the embodiment of FIG. 1, the cross-sectional surface around the center of the sphere (FIG. 2*b*) is substantially larger than, for instance, in the pole region (FIG. 2*c*). In this way, the stiffness and the damping of the damping element can be precisely adjusted.

The damping means 20 can further comprise a transmitting and/or guiding element 22. Said element can be firmly attached to the lower heel part 2 and can terminate in a bore or recess 4 in the upper heel part 3 such that the forces acting in the heel's longitudinal direction between the lower heel part 2 and the upper heel part 3, are, in essence, transmitted via the damping element 21 only. If the transmitting and/or guiding element 22 is guided laterally in the recess 4 of the upper heel part, forces and/or shocks which do not act in the heel's longitudinal direction can be directly transmitted from one heel part to the other via the element 22. Since the transmitting and/or guiding element 22 is guided through the damping element 21, a lateral breakaway of the damping element 21 under load in the heel's longitudinal direction is prevented.

Alternatively or additionally, a sleeve 25 can be provided in the recess 4 of the upper heel part 3 or in a corresponding recess in the lower heel part 2 (not depicted), which extends downwardly from the upper heel part and provides a larger surface for guiding the transmitting and/or guiding element 22. The connection between the transmitting and/or guiding element 22 and the lower heel part 2 and/or the upper heel part 3 can be provided by a form-fit, a bonding and/or frictional engagement, for example.

Alternatively or additionally, the damping element 21 can be directly firmly attached to the lower heel part 2 and/or the upper heel part 3, e.g. by gluing.

Figure 4:
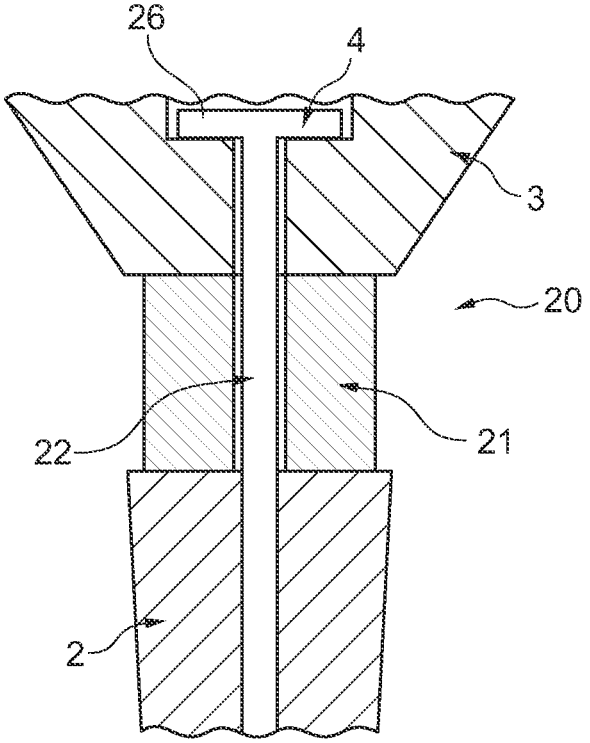
FIG. 4 a detail of a cross-sectional view similar to the one of FIG. 2*a*, showing a further mounting option for a damping means in a high-heeled shoe according to the present invention.

In the embodiment shown in FIG. 2*a*, the guiding element 22, in an exemplary manner, is held in the recess 4 by means of a spring 24 which can also be replaced by a very elastic plastic material. As shown in FIG. 4, the guiding element 22 can be alternatively or additionally prevented from sliding out by means of an enlargement at the upper end of the guiding element 22, namely a head 26. If the head 26 is an integral part of the guiding element 22, the guiding element can, for instance, be pushed through the upper heel part 3 from the side of the foot's heel and—after threading the damping element 21 thereon—be connected and/or screwed together with the lower heel part 2 and/or the heel tip 5. The guiding element 22 can also comprise a thread or a push fitting at the upper end so that the head 26 is screwed or fitted onto the guiding element 22 after the guiding element 22 has been inserted in the upper heel part 3 from below and guided to the recess 4. Further types of connection which guarantee the required degree of freedom and a simple replacement of the damping element 21 are also possible.

Figure 3:
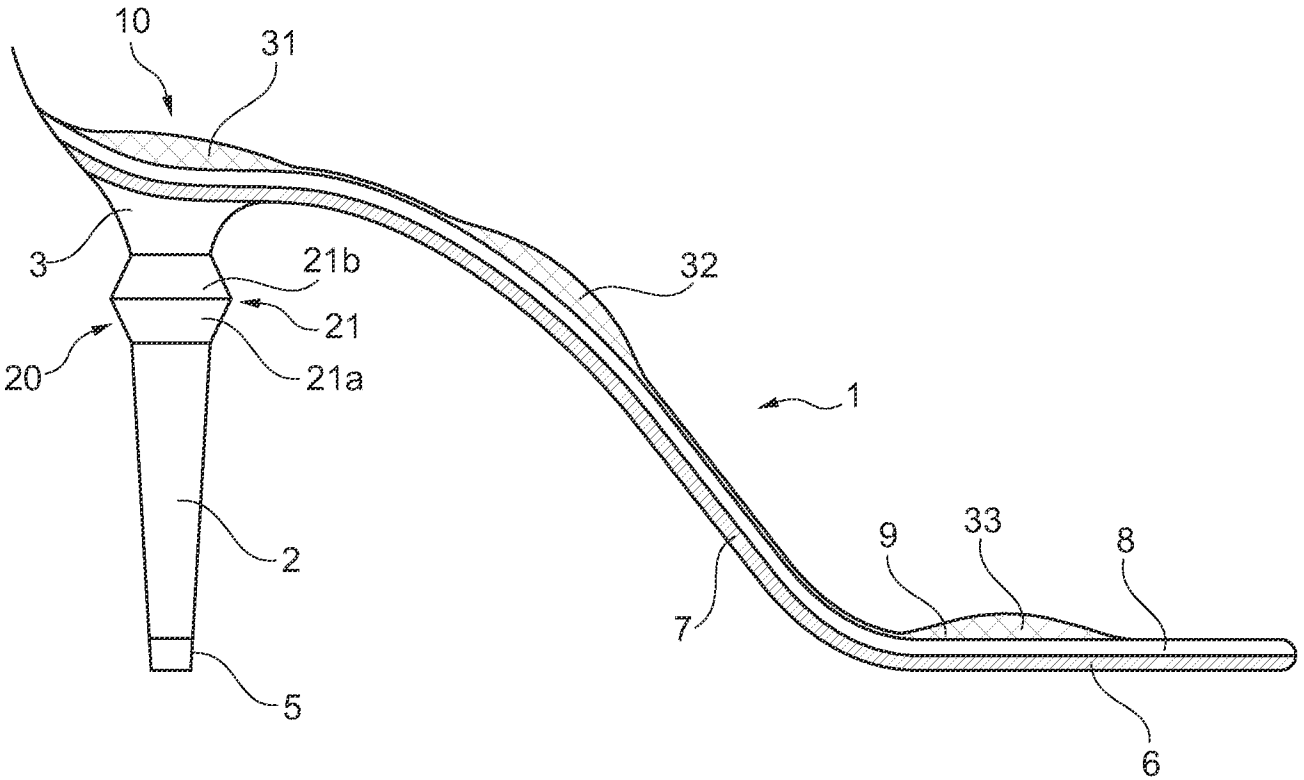
FIG. 3 a schematic side view of a high-heeled shoe comprising a damping means in the heel according to a further embodiment of the invention.

A further embodiment of a high-heeled shoe 1 according to the present invention is shown in FIG. 3. The basic set-up of the shoe 1 is similar to the embodiment shown in FIGS. 1 and 2*a*-2*c*, but differs in the shape of the damping element 21 of the damping means 20. As depicted in FIG. 3, the damping element 21 is formed by two truncated cones 21*a*, 21*b* which are placed on top of each other. The two truncated cones 21*a*, 21*b* forming the damping element 21 can be configured as an integral or one-piece part or as a two-piece component, i.e. as two damping elements 21*a*, 21*b* which are connected in series.

Figure 5A:
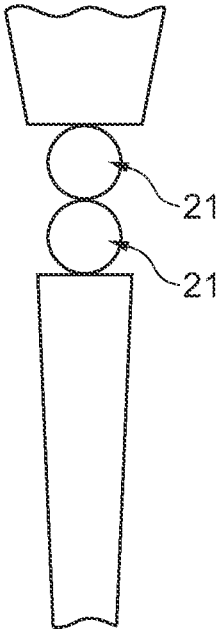
FIGS. 5*a*-5*c* schematic rear views of various embodiments of the damping means of a high-heeled shoe according to the present invention.
Figure 5B:
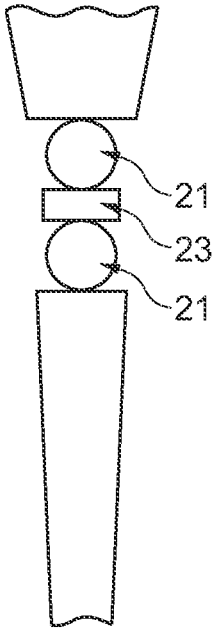
Figure 5C:
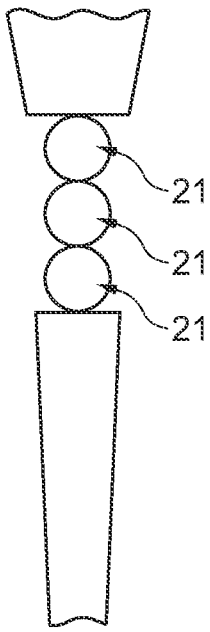

The damping means of a high-heeled shoe 1 according to the present invention can comprise several damping elements 21 in parallel or serial arrangement. FIGS. 5*a* to 5*c* show rear views of heels of high-heeled shoes according to further embodiments of the invention. As can be taken from said Figures, the damping means 20 can comprise, for example, several spherical damping elements 21 or additionally damping or non-damping elements 23 made of rigid material, e.g., hard plastics or metal.

The damping means 20 can also be arranged inside the heel. In the embodiment of the invention shown in FIG. 6*a*, the damping means 20 is located in a chamber 11 inside the lower heel part 2 which, for example, can be at least partially designed as a sleeve for this purpose. At least one damping element which is freely deformable in at least one direction perpendicular to the heel's longitudinal axis and/or comprises different effective damping cross sections along the heel's longitudinal axis is provided inside the heel. The damping element can, for example, be provided in the form of one or more gel pads or other elastic materials 21.

The sleeve-like lower heel part 2 can, for example, be made of hard plastics or metal and serves as guiding element. However, an additional guiding element 22 extending through the damping elements 21 can also be provided, as previously described in connection with the embodiment of FIG. 1. Preferably, stabilizing elements 27 made of rigid material, such as medium-hard or hard plastics or metal, are placed inside the sleeve between the damping elements 21 for transmitting force and stabilizing the heel. The stabilizing elements 27 can abut on the sleeve's margin and support the sleeve. In combination with the sleeve-like lower heel part 2, the heel's stability can thus be ensured.

Figure 6D:
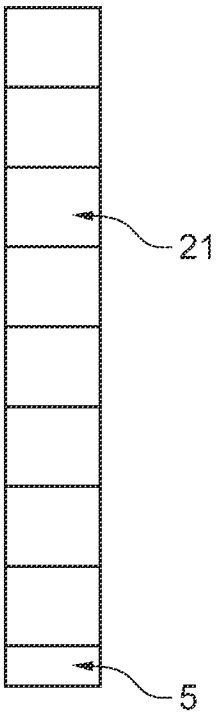
FIG. 6*a*-6*d* schematic cross-sectional views of further embodiments of the damping means of a high-heeled shoe according to the present invention.
Figure 6C:
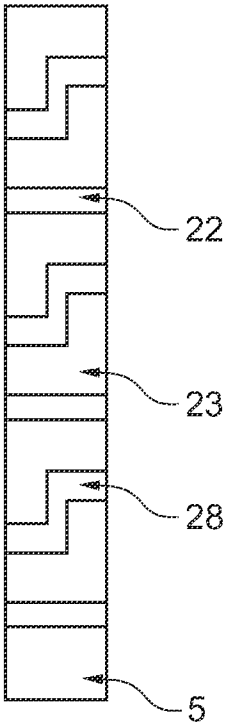
Figure 6B:
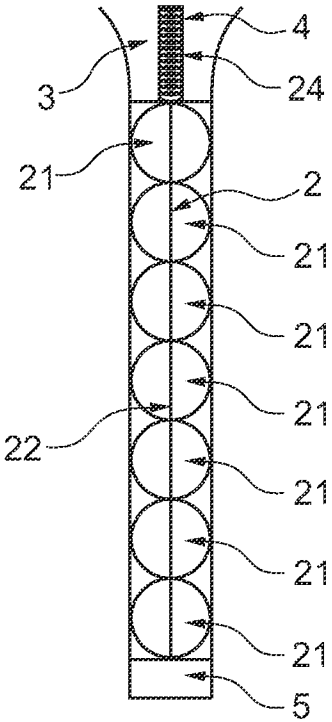
Figure 6A:
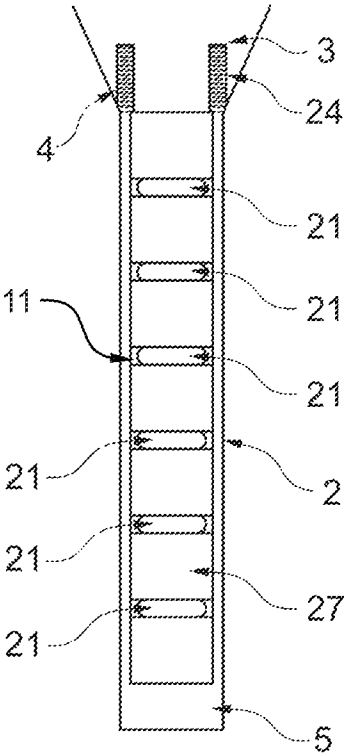
Figure 7A:
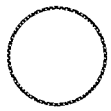
Figure 7B:
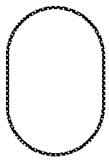
Figure 7C:
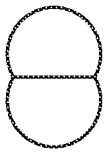
Figure 7D:
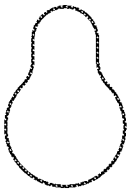
Figure 7E:
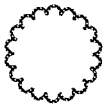
Figure 7F:
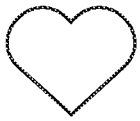
Figure 7G:
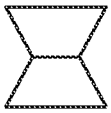
Figure 7H:
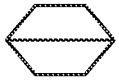
Figure 7I:
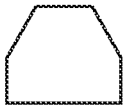
Figure 7J:
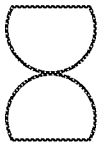
Figure 7K:
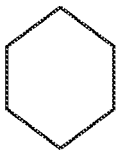
Figure 7M:
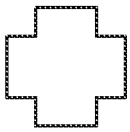

In the embodiment illustrated in FIG. 6*a*, the sleeve-like lower heel part 2 can be held via a spring 24 in a, for example, annular recess 4 of the upper heel part 3, as described above.

As shown in FIG. 6*b*, the lower heel part 2 of a high-heeled shoe according to the present invention can essentially consist of the heel tip 5 only, which is directly connected to the guiding element 22. In this case the space between the heel tip 5 and the upper heel part 3 can be completely taken up by one or several damping elements 21. Alternatively, a combination of one or more damping elements and the stabilizing elements can be provided.

FIG. 6*c* shows a rear view of the heel of a high-heeled shoe according to the present invention. As can be seen from this embodiment, the damping means can also comprise a combination of diverse damping elements, such as gel pads, polymer dampers (or other elastic materials) 28. Polymer dampers 28 and/or gel pads can comprise different effective damping cross sections along the heel's longitudinal axis. Stabilizing elements 27 made of rigid material can be provided between the individual polymer dampers 28 and/or the gel pads in order to ensure stability of the heel.

As shown in FIG. 6*d*, the damping element 21 of a high-heeled shoe according to the present invention can also be composed of several, for example cylindrical elements having similar or different diameters. The embodiments shown in FIGS. 6*c* and 6*d* can be designed with or without a guiding element.

FIGS. 7*a* to 7*m* show examples of further shapes for damping elements to be used in high-heeled shoes according to the present invention. All of these shapes have at least two different effective damping cross sections. It is particularly preferred that the damping elements intended for use in the present invention comprise considerably more different effective damping cross sections.

Preferably, the high-heeled shoe according to the present invention further comprises a piston-cylinder connection 40 by which the transmitting and/or guiding element is mounted in the upper heel part such that it can move in an axial direction of the heel. Further embodiments of piston-cylinder connections 40 according to the present invention are depicted in FIGS. 8*a* to 8*d*, 9*a* to 9*d*, 10*a*, 10*b* and 11. For reasons of clarity, the damping means according to the present invention and the lower heel part are not depicted in these Figures.

Figure 8A:
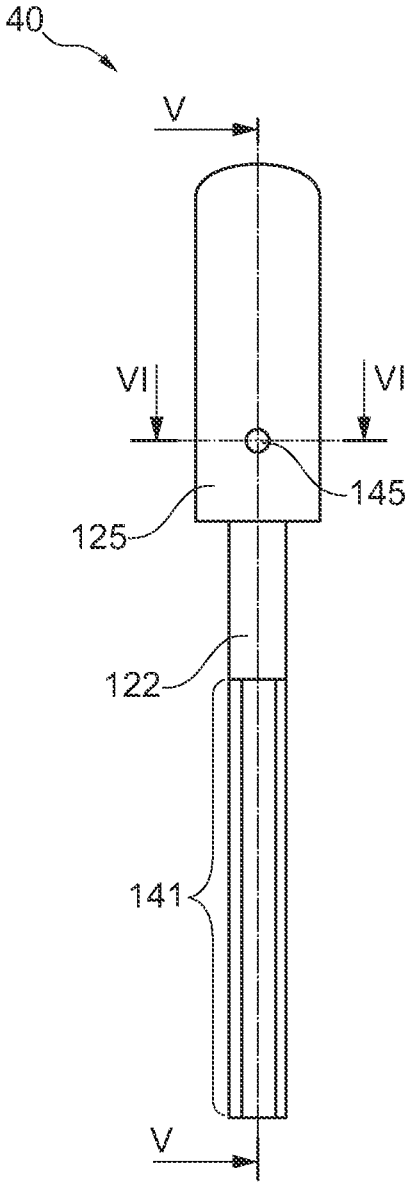
FIG. 8*a* a schematic rear view of a piston-cylinder connection according to a first embodiment for use in a high-heeled shoe according to the present invention.

A first embodiment of the piston-cylinder connection 40 according to the present invention is schematically shown in FIGS. 8*a* to 8*d*. As illustrated in FIG. 8*a*, the piston-cylinder connection 40 preferably comprises a surrounding cylinder 125 and a piston which is essentially formed by the guiding element 122. At that, the surrounding cylinder 125 is connected with or formed by the upper heel part, which is why the cylinder can also be described as cylindrical opening in the upper heel part. The piston is preferably connected with a guiding element 122 which runs through the damping element according to the present invention, as described above. In the shown embodiment, the piston is formed integrally with the guiding element 122. It is further shown that the guiding element 122 can comprise an external thread 141 at its lower end, through which a lower heel part 2 can be screwed onto the guiding element 122. Moreover, an optional internal thread 143 enables the mounting of the heel tip (see FIG. 8*b*). As can be taken from FIG. 8*c* which shows a cross section of the piston-cylinder connection 40 of FIG. 8*a* along the line VI-VI, the surrounding cylinder 125 and the guiding element 122 preferably have a circular cross section according to this embodiment.

Figure 8B:
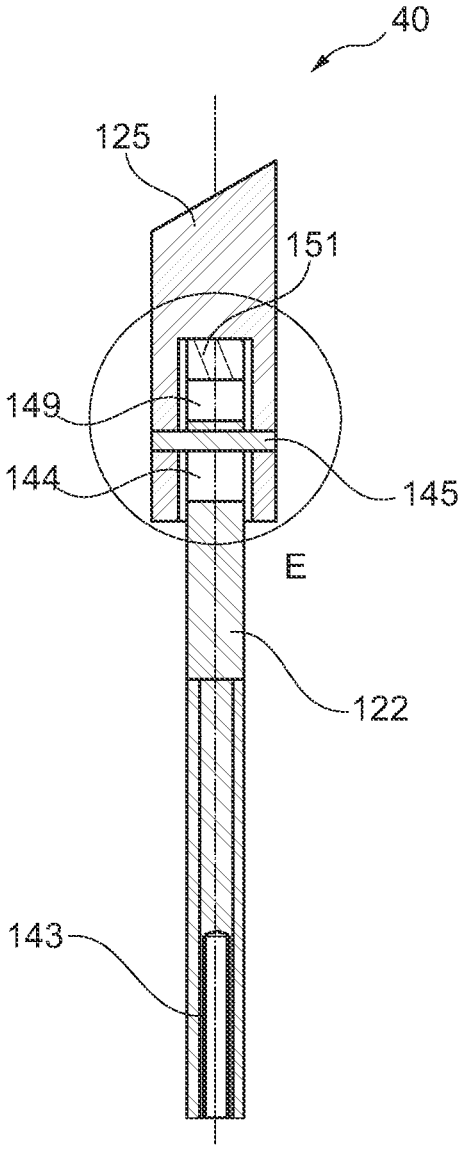
FIG. 8*b* a cross-sectional view along the line V-V of FIG. 8*a* showing the structure of the piston-cylinder connection.

FIG. 8*b* shows an intersection along the line V-V of FIG. 8*a* illustrating the mounting of the guiding element 122 in the surrounding cylinder 125, which allows for movement in an axial direction. As can be seen best from the enlarged detail view of FIG. 8*d*, a pin 145, which is pushed through an elongate opening 144 in the upper region of the guiding element 122 and is mounted in or on the cylinder 125, prevents the guiding element 122 from sliding out of the cylinder 125 further than a maximum position when the heel is lifted. In addition, the guiding element 122 is prevented from rotating with respect to the upper heel part, which counteracts a loosening of the screwed-on lower heel part and/or the heel tip.

Figure 8D:
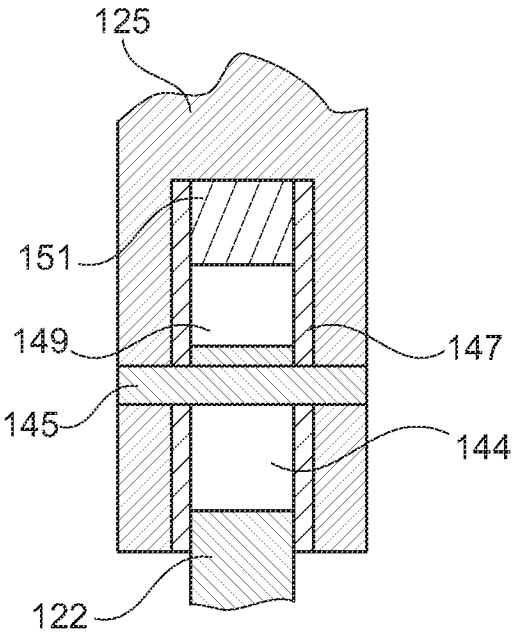
FIG. 8*d* a detail E of the cross-sectional view of FIG. 8*b;*
Figure 8C:
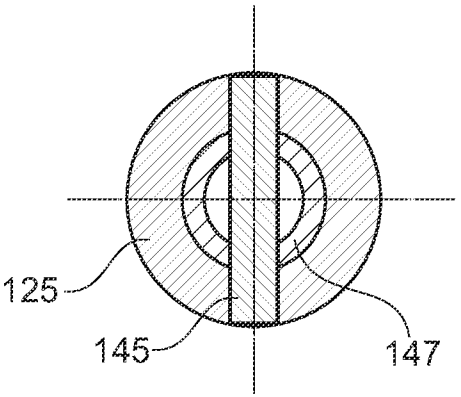
FIG. 8*c* a cross-sectional view along the lines VI-VI of FIG. 8*a;*

Due to its axial moveability, the guiding element 122 is shifted upwardly in the heel's longitudinal direction when the heel is loaded and the damping element according to the present invention deforms correspondingly (not depicted in FIG. 8*d*). The piston-cylinder connection 40, therefore, is provided with an upper buffer 151 which is preferably made of elastic plastics. Said buffer prevents the bumping or undamped bouncing of the piston against the cylinder's axial upper end and, thus, reduces the generation of noise when the heel is loaded. Alternatively, the upper buffer 151 can be made of polymers (e.g., thermoplastics, elastomers, thermoplastic synthetic materials), polyurethane, natural rubber, rubber or rubber-like plastics, foams and/or cork or cork compounds (e.g., cork-latex compounds).

In addition to the buffer 151, a sleeve 147 (e.g., made of industrial ceramics or plastics) is provided as a means of noise reduction in order to further reduce the generation of noise when striking the ground with and/or lifting a high-heeled shoe according to the present invention. The opening 144 of the guiding element 122 and/or the pin 145 can be provided with a DLC coating or another friction-reducing coating in order to reduce sliding friction between these components.

Figure 9A:
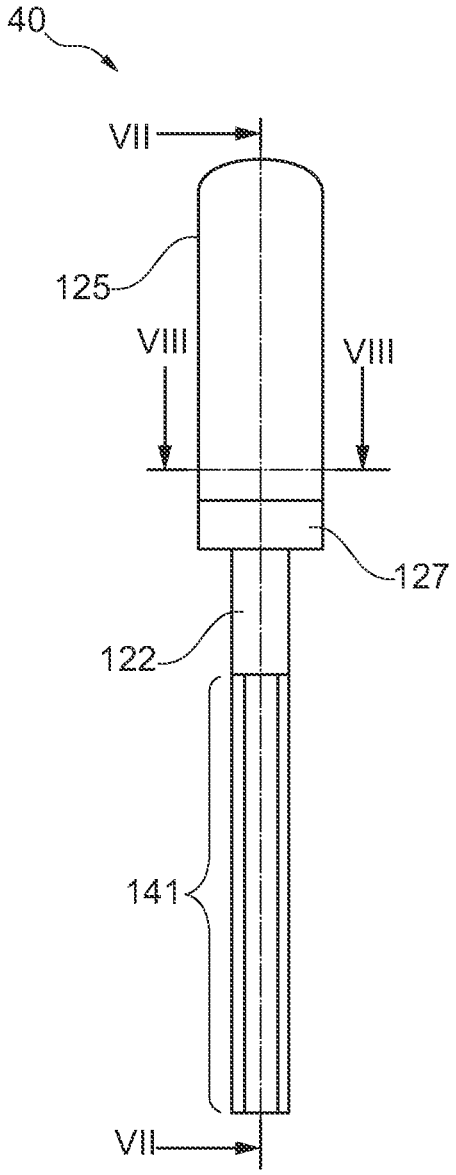
FIG. 9*a* a schematic rear view of a piston-cylinder connection according to a further embodiment for use in a high-heeled shoe according to the present invention.

FIGS. 9*a* to 9*d* show a further embodiment of a piston-cylinder connection 40 for use in a high-heeled shoe according to the present invention. Identical reference signs relate to elements which correspond to those of previously described embodiments. As shown in FIG. 9*a*, the piston-cylinder connection again comprises a surrounding cylinder 125 and a piston which is formed by the guiding element 122.

Figure 9B:
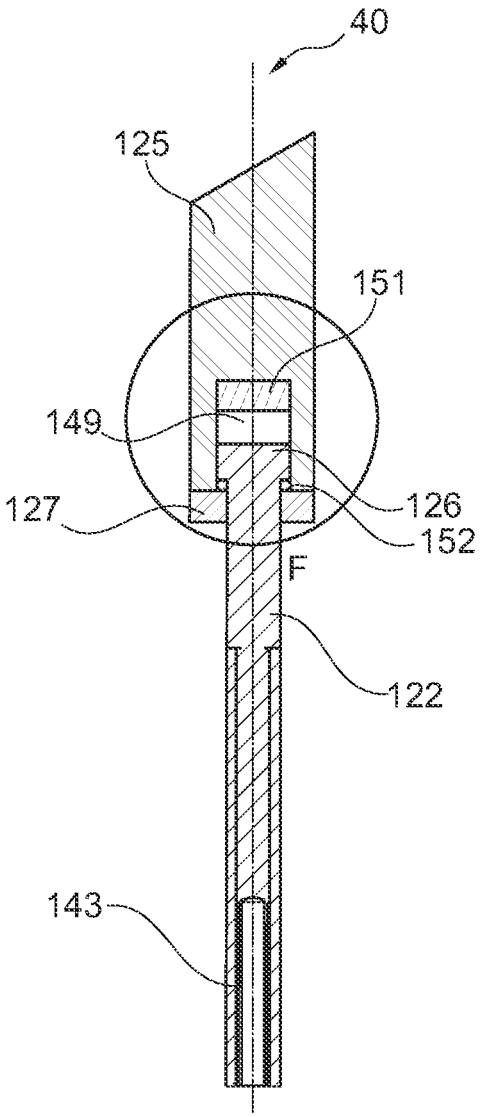
FIG. 9*b* a cross-sectional view along the line VII-VII of FIG. 9*a* showing the structure of the piston-cylinder connection.
Figure 9D:
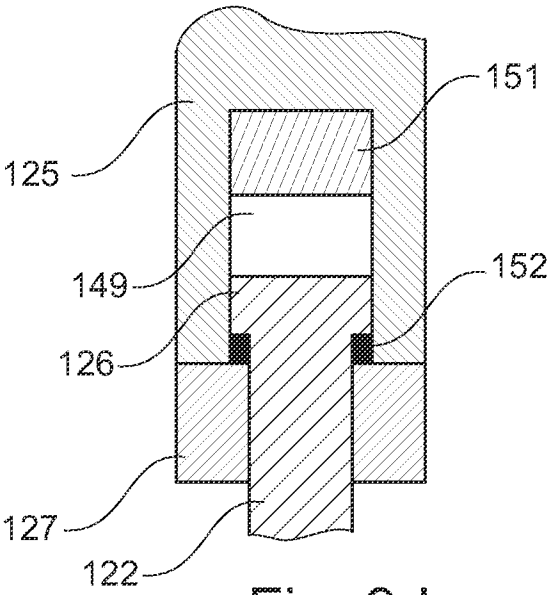
FIG. 9*d* a detail F of the cross-sectional view of FIG. 9*b;*

FIG. 9*b* shows the section along the line VII-VII of FIG. 9*a*, wherein FIG. 9*d* depicts detail F. The surrounding cylinder 125 is open at its lower end as can be seen from these Figures. Hence, the upper end region of guiding element 122 which comprises an enlarged cross-sectional area or head 126 can be inserted into the surrounding cylinder. Subsequently, an end piece 127 which comprises a through-hole for the guiding element 122 is slid over said guiding element and attached to the cylinder (e.g. by screwing, welding, gluing, soldering, nailing or by using engaging mechanisms). The end piece 127 thus prevents the upper end region of the guiding element 122 from sliding out of the cylinder 125.

The piston-cylinder connection according to FIGS. 9*a* to 9*d* comprises an upper buffer 151 in a clearance 149 between the guiding element 122 and the cylinder 125. As previously described, said upper buffer can form an upper end stop and reduce the generation of noise when the heel strikes the ground. Moreover, a lower buffer 152 is provided between the head 126 of the guiding element 122 and the end piece 127 of the cylinder. In the given example, the lower buffer has an annular configuration and can, for example, be made of an elastomer. The lower buffer reduces the generation of noise when the heel of the high-heeled shoes according to the present invention is lifted from the ground, when the load is taken off the heel and the guiding element returns to its extended position due to the elastic resetting of the damping means (not depicted in the Figures).

In order to further reduce the generation of noise, the inner wall of the cylinder 125 and/or the outer wall of the upper part of the guiding element 122 inserted therein can be fully or partially provided with a friction-reducing coating (e.g., plastics or DLC).

Figure 9C:
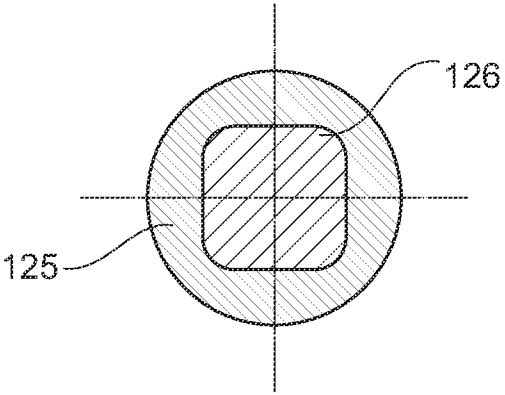
FIG. 9*c* a cross-sectional view along the line VIII-VIII of FIG. 9*a;*

As shown in FIG. 9*c*, the inner wall of the cylinder 125 just as the outer wall of the head 126 comprise non-circular profiles at the upper end of the guiding element 122. Hence, the contact between the inner wall of the cylinder 125 and the outer wall of the guiding element 122 prevents the rotation of the guiding element 122. Consequently, the guiding element 122 is protected against rotating in the heel.

Figure 10A:
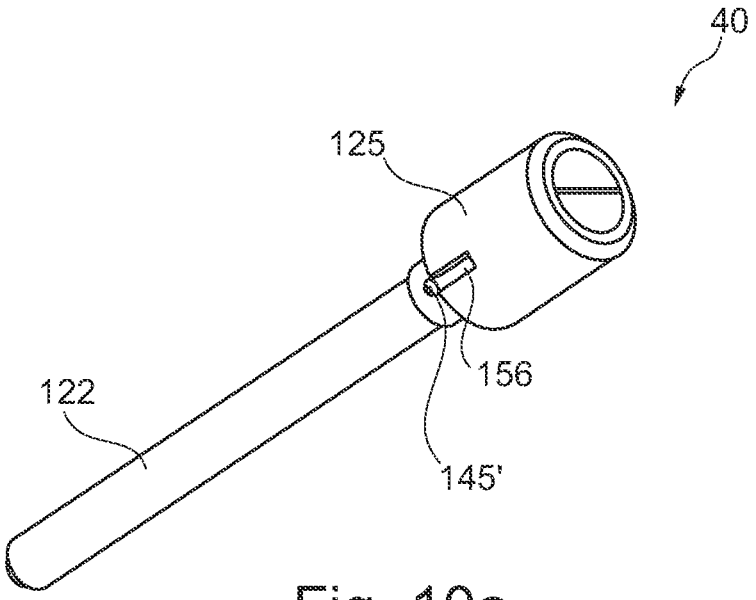
FIG. 10*a* a perspective, schematic view of a piston-cylinder connection according to a further embodiment of the invention for use in a high-heeled shoe according to the present invention.
Figure 10B:
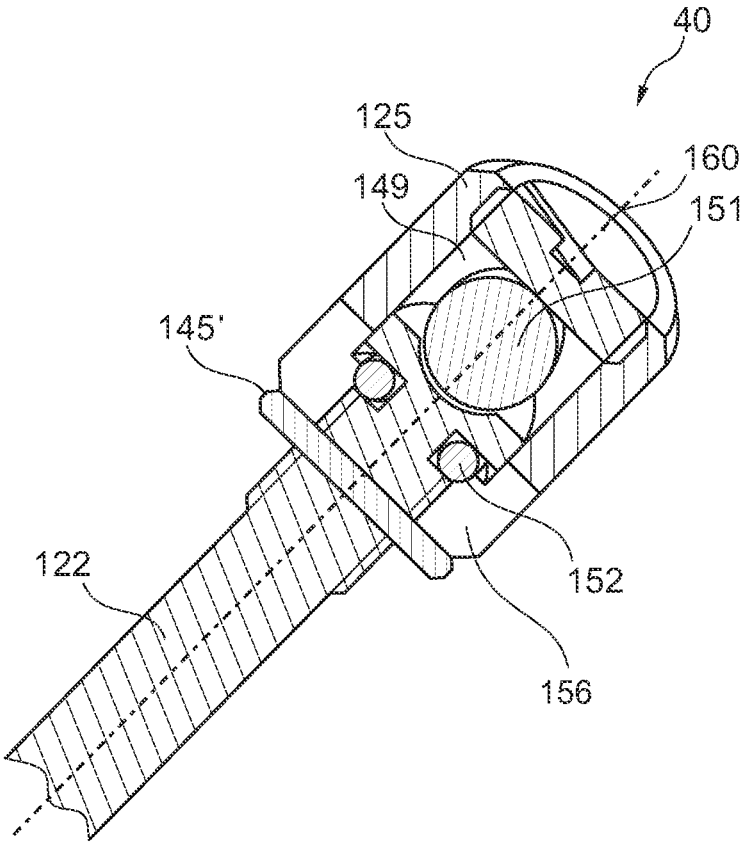
FIG. 10*b* a perspective, longitudinal cross-sectional view showing the piston-cylinder connection of FIG. 10*a* turned by 90°.

FIGS. 10*a* and 10*b* exemplary show a further embodiment of the piston-cylinder connection in which the rotation of the guiding element 122 with respect to the cylinder 125 is prevented by the pin 145' which is firmly attached to the guiding element 122 and accommodated in an axial groove 156 of the cylinder. The upper buffer 151' can have different shapes (spheres, cylinders, etc.) and thicknesses and is at least to a certain degree freely deformable in a direction transverse to the heel's longitudinal axis in the clearance 149 between the upper end of the guiding element 122 and the cylinder 125. Hence, the upper buffer 151' does not only minimize the generation of noise when the heel strikes the ground, but to a certain extent also supports the damping effect of the damping element of the high-heeled shoe according to the present invention (not shown in FIGS. 10*a* and 10*b*). The shape of the buffer can influence the specific damping properties, as described above with respect to the damping element. Since the stiffness of the upper buffer 151' increases considerably when abutted on the inner wall of the cylinder 125, the cylinder further provides an upper end stop which restricts the upwards movement of the guiding element. In the embodiment shown, the lower end piece of the cylinder 125 forms an integral part of the cylinder. The upper end of the cylinder 125 is sealed by a lid 160.

Figure 11:
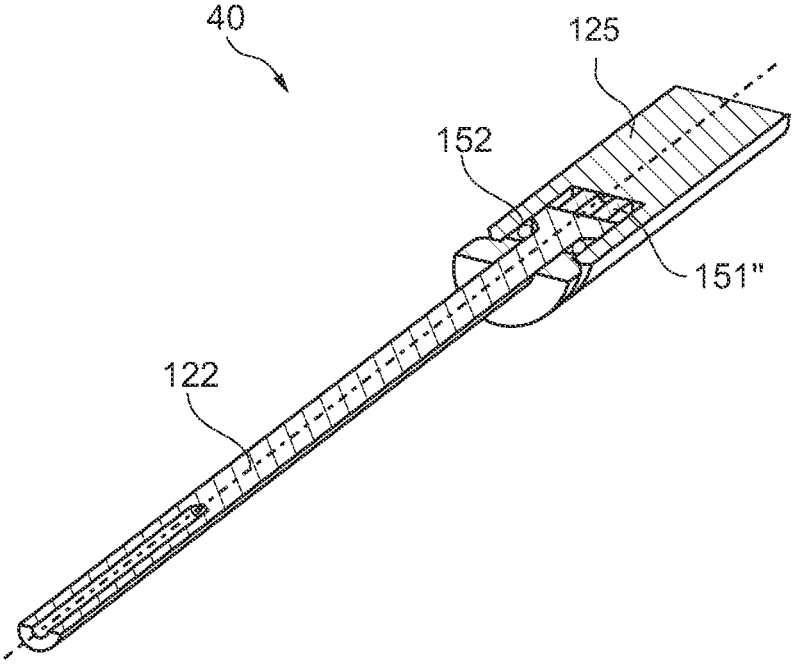
FIG. 11 a perspective, longitudinal cross-sectional view of a piston-cylinder connection according to a further embodiment for use in a high-heeled shoe according to the present invention.

FIG. 11 shows a further embodiment of the piston cylinder connection 40 for use in a high-heeled shoe according to the present invention, in which the upper buffer 151" is configured as hollow cylinder.

Thus, the present invention as well as the embodiments described in more detail provide high-heeled shoes with a stable and functioning damping means which allows for a slender design of damping heels. At the same time, the damping properties can be flexibly adjusted to the wearer's requirements and individual walking pattern and adapted to the cushion and shoe design in order to optimize the standing and walking pattern as well as the wearing comfort. In addition, particularly advantageous configurations of the heel structure are disclosed by means of a piston-cylinder connection, which impede the generation of audible sounds and have a long service life, thus overcoming considerable problems which, until now, opposed the use of damped high-heeled shoes in practice.

What is claimed is:

1. A high-heeled shoe comprising: a sole and a heel, the heel being at least 4 centimeters (cm) in height, wherein the heel has a longitudinal axis intersecting a top and a bottom of the heel, the heel being provided with a damping device, wherein the heel has a top portion and a bottom portion separated by a vertical midpoint along the longitudinal axis, wherein the damping device comprises at least one damping element and a guiding element extending through the at least one damping element, wherein the at least one damping element is arranged entirely within the top portion of the heel, wherein the guiding element is mounted in the top portion of the heel by means of a piston-cylinder connection so as to be movable in the heel's longitudinal direction and extends over at least 60% of the heel's height, wherein at least one of a heel diameter and a heel width is no larger than 4 cm in the region of the at least one damping element, wherein the at least one damping element has different effective damping cross-sections along the heel's longitudinal axis and is freely deformable in at least one direction perpendicular to the heel's longitudinal axis, wherein a ratio of a largest cross-sectional area to a smallest cross-sectional area of the at least one damping element in a cross-section perpendicular to the longitudinal axis is at least 1.3, and wherein a total volume of the least one damping element ranges between 0.5 and 15.0 $cm^3$.

2. The high-heeled shoe according to claim 1, wherein the ratio of the largest cross-sectional area to the smallest cross-sectional area of the at least one damping element in a cross-section perpendicular to the longitudinal axis is at least 1.5.

3. The high-heeled shoe according to claim 1, wherein the at least one damping element is visible from outside or arranged in a chamber of the heel.

4. The high-heeled shoe according to claim 1, wherein at least one of the heel diameter and heel width is no larger than 2 cm in the region of the at least one damping element.

5. The high-heeled shoe according to claim 1, wherein at least one of the heel diameter and heel width is no larger than 1.5 cm in the region of the at least one damping element.

6. The high-heeled shoe according to claim 1, wherein a ratio of heel height to at least one of the heel diameter in the region of the at least one damping element and the heel width in the region of the at least one damping element is at least 2.5.

7. The high-heeled shoe according to claim 1, wherein a ratio of heel height to at least one of the heel diameter in the region of the at least one damping element and the heel width in the region of the at least one damping element is at least 4.0.

8. The high-heeled shoe according to claim 1, wherein a ratio of heel height to at least one of the heel diameter in the region of the at least one damping element and the heel width in the region of the at least one damping element is at least 5.0.

9. The high-heeled shoe according to claim 1, wherein a ratio of heel height to at least one of the heel diameter in the region of the at least one damping element and the heel width in the region of the at least one damping element is at least 7.5.

10. The high-heeled shoe according to claim 1, wherein a ratio of heel height to at least one of the heel diameter in the region of the at least one damping element and the heel width in the region of the at least one damping element ranges between 2.5 and 15.0.

11. The high-heeled shoe according to claim 1, wherein a ratio of heel height to at least one of the heel diameter in the region of the at least one damping element and the heel width in the region of the at least one damping element ranges between 4.0 and 12.0.

12. The high-heeled shoe according to claim 1, wherein the at least one damping element has a height of at least 1 cm in an axial direction of the heel.

13. The high-heeled shoe according to claim 1, wherein the at least one damping element has a height of at least 2 cm in an axial direction of the heel.

14. The high-heeled shoe according to claim 1, wherein the at least one damping element has a height of at least 3 cm in an axial direction of the heel.

15. The high-heeled shoe according to claim 1, wherein the at least one damping element has a height of at least 4 cm in an axial direction of the heel.

16. The high-heeled shoe according to claim 1, wherein the at least one damping element comprises a gel pad or solid, compressible material.

17. The high-heeled shoe according to claim 1, wherein the at least one damping element is selected from the group consisting of: an elastomer, a thermoplastic synthetic material, cork, foam, latex and gel.

18. The high-heeled shoe according to claim 1, wherein the total volume of the at least one damping element ranges between 1.75 and 5.0 $cm^3$.

19. The high-heeled shoe according to claim 1, wherein the total volume of the at least one damping element ranges between 1.5 and 4.0 $cm^3$.

20. The high-heeled shoe according to claim 1, wherein the piston-cylinder connection comprises at least one means for noise reduction which reduces the generation of noise when at least one of the heel being loaded and load being taken off the heel occurs.

21. The high-heeled shoe according to claim 20, wherein the piston-cylinder connection comprises at least one buffer configured such that the abutment of the piston against an axial end of the cylinder is at least one of prevented and damped, wherein the buffer is made of a polymeric material.

22. The high-heeled shoe according to claim 1, wherein at least one of the piston and the cylinder comprise a low-friction surface.

23. The high-heeled shoe according to claim 22, wherein at least one of the piston and the cylinder are provided with a sleeve made of a low-friction material.

24. The high-heeled shoe according to claim 1, wherein the piston-cylinder connection comprises an anti-rotation protection which counteracts or prevents a rotation of the piston in the cylinder.

25. The high-heeled shoe according to claim 1, wherein the ratio of the largest cross-sectional area to the smallest cross-sectional area of the at least one damping element in a cross-section perpendicular to the longitudinal axis is at least 4.0.

* * * * *